US010065413B2

(12) United States Patent
Yokoyama et al.

(10) Patent No.: US 10,065,413 B2
(45) Date of Patent: Sep. 4, 2018

(54) LIQUID DISCHARGING DEVICE, CONTROL APPARATUS FOR LIQUID DISCHARGING DEVICE, AND METHOD OF CONTROLLING LIQUID DISCHARGING DEVICE

(71) Applicants: Ryoh Yokoyama, Kanagawa (JP); Yoshimi Nemoto, Kanagawa (JP); Kenichi Taguma, Kanagawa (JP); Tetsuto Ueda, Kanagawa (JP); Naohiro Toda, Kanagawa (JP); Yasunobu Takagi, Kanagawa (JP); Shotaro Ueda, Kanagawa (JP)

(72) Inventors: Ryoh Yokoyama, Kanagawa (JP); Yoshimi Nemoto, Kanagawa (JP); Kenichi Taguma, Kanagawa (JP); Tetsuto Ueda, Kanagawa (JP); Naohiro Toda, Kanagawa (JP); Yasunobu Takagi, Kanagawa (JP); Shotaro Ueda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/372,582

(22) Filed: Dec. 8, 2016

(65) Prior Publication Data

US 2017/0165970 A1 Jun. 15, 2017

(30) Foreign Application Priority Data

Dec. 9, 2015 (JP) ..... 2015-240256

(51) Int. Cl.

| | |
|---|---|
| ***B41J 2/165*** | (2006.01) |
| ***B41J 2/01*** | (2006.01) |
| ***B41J 2/21*** | (2006.01) |

(52) U.S. Cl.

CPC ..... *B41J 2/01* (2013.01); *B41J 2/165* (2013.01); *B41J 2/16517* (2013.01); *B41J 2/2139* (2013.01); *B41J 2/16579* (2013.01)

(58) Field of Classification Search

CPC ... B41J 2/01; B41J 2/2139; B41J 2/165; B41J 2/16517; B41J 2/16579

See application file for complete search history.

(56) References Cited

U.S. PATENT DOCUMENTS

2011/0063366 A1* 3/2011 Sato ..... B41J 2/16526 347/33
2011/0084996 A1* 4/2011 Hirato ..... B41J 2/0451 347/10
2011/0090276 A1 4/2011 Hirano et al.

FOREIGN PATENT DOCUMENTS

JP 2010-017918 1/2010

* cited by examiner

*Primary Examiner* — Yaovi M Ameh
(74) *Attorney, Agent, or Firm* — Oblon, McClelland, Maier & Neustadt, L.L.P.

(57) ABSTRACT

A liquid discharging device detects, among a plurality of nozzles of a liquid discharging head, a normal-discharging nozzle and a false-discharging nozzle, selects whether to recover discharging performance of the false-discharging nozzle by a cleaner or to compensate deterioration in an image caused by the false-discharging nozzle by a compensator using the normal-discharging nozzle according to the detected number of consecutive false-discharging nozzles, and performs operation according to the selection.

10 Claims, 11 Drawing Sheets

○ NOZZLE
● FALSE-DISCHARGING NOZZLE

○ NOZZLE
● FALSE-DISCHARGING NOZZLE

○ NOZZLE
● FALSE-DISCHARGING NOZZLE

FIG. 7

| | EXAMPLE PATTERN OF COMBINATION OF FALSE-DISCHARGING NOZZLES FOR THREE CONSECUTIVE FALSE-DISCHARGED PIXELS |
|---|---|
| A: WHEN PRINTED LOCATIONS ARE CONSECUTIVE IN NOZZLE ROW | CH1 AND CH2 AND CH3 |
| | CH2 AND CH3 AND CH4 |
| | ・・・ |
| B: WHEN PRINTED LOCATIONS ARE CONSECUTIVE AMONG CONNECTED NOZZLES | HEAD1 CH99 AND HEAD1 CH100 AND HEAD2 CH1 |
| | HEAD1 CH100 AND HEAD2 CH1 AND HEAD2 CH2 |
| | ・・・ |
| C: WHEN PRINTED LOCATIONS ARE CONSECUTIVE AMONG SCANS | HEAD1 CH3 AND HEAD1 CH10 AND HEAD1 CH17 |
| | HEAD1 CH4 AND HEAD2 CH11 AND HEAD2 CH18 |
| | ・・・ |

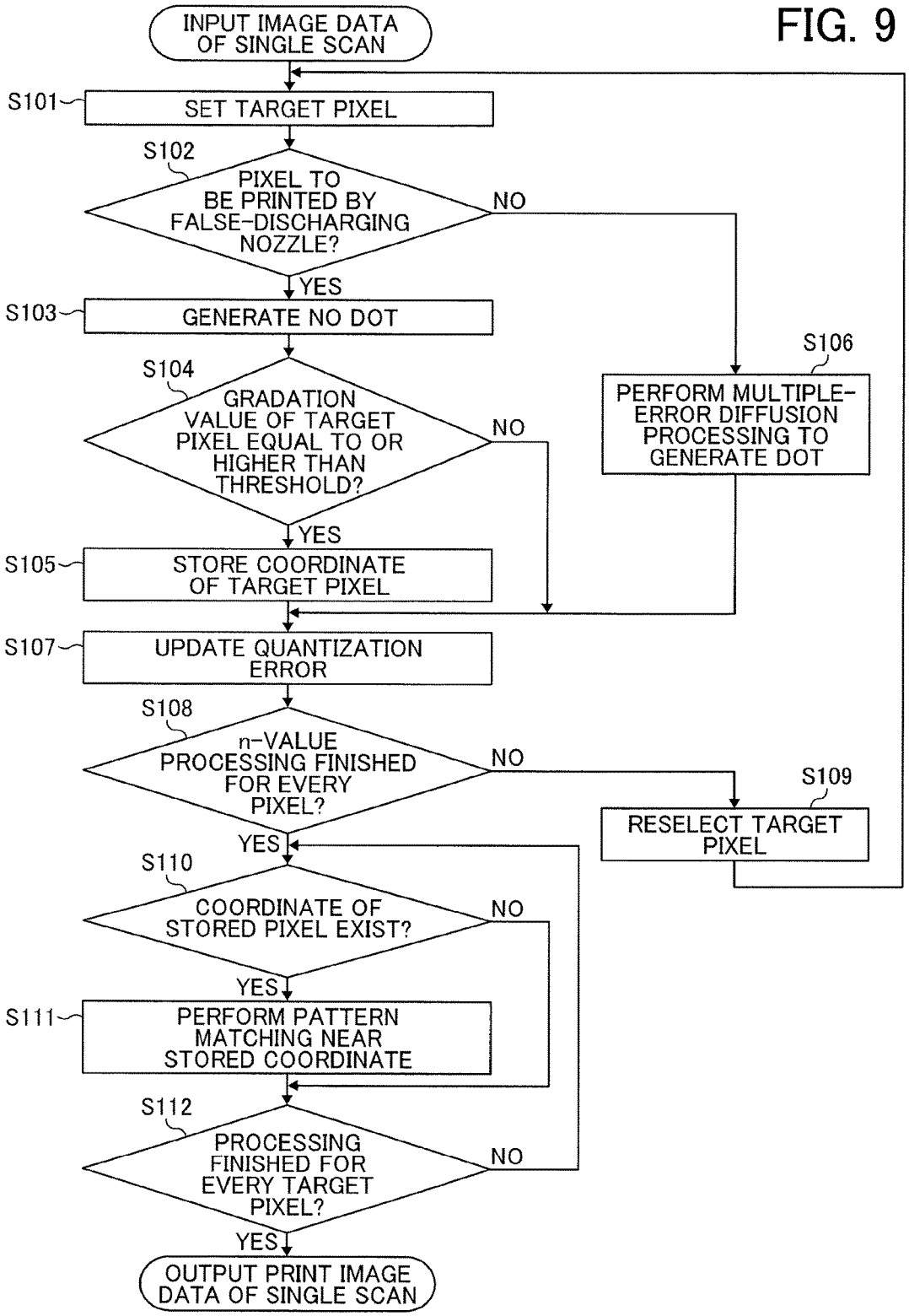
FIG. 9
INPUT IMAGE DATA OF SINGLE SCAN
S101
SET TARGET PIXEL
S102
PIXEL TO BE PRINTED BY FALSE-DISCHARGING NOZZLE?
NO
YES
S103
GENERATE NO DOT
S104
GRADATION VALUE OF TARGET PIXEL EQUAL TO OR HIGHER THAN THRESHOLD?
NO
YES
S106
PERFORM MULTIPLE-ERROR DIFFUSION PROCESSING TO GENERATE DOT
S105
STORE COORDINATE OF TARGET PIXEL
S107
UPDATE QUANTIZATION ERROR
S108
n-VALUE PROCESSING FINISHED FOR EVERY PIXEL?
NO
YES
S109
RESELECT TARGET PIXEL
S110
COORDINATE OF STORED PIXEL EXIST?
NO
YES
S111
PERFORM PATTERN MATCHING NEAR STORED COORDINATE
S112
PROCESSING FINISHED FOR EVERY TARGET PIXEL?
NO
YES
OUTPUT PRINT IMAGE DATA OF SINGLE SCAN

| NOZZLE | REGULAR SHEET, HIGH SPEED | REGULAR SHEET, NORMAL SPEED | ... |
|---|---|---|---|
| H1o1 | H1e192 | · | · |
| H1o2 | H1e1 | · | · |
| · | · | · | · |
| · | · | · | · |
| · | · | · | · |
| H1o191 | H1e190 | · | · |
| H1o192 | H1e191 | · | · |

LIQUID DISCHARGING DEVICE, CONTROL APPARATUS FOR LIQUID DISCHARGING DEVICE, AND METHOD OF CONTROLLING LIQUID DISCHARGING DEVICE

CROSS-REFERENCE TO RELATED APPLICATIONS

This patent application is based on and claims priority pursuant to 35 U.S.C. § 119(a) to Japanese Patent Application No. 2015-240256, filed on Dec. 9, 2015, in the Japan Patent Office, the entire disclosure of which is hereby incorporated by reference herein.

BACKGROUND

Technical Field

The present invention relates to a liquid discharging device, a control apparatus for the liquid discharging device, and a method of controlling the liquid discharging device.

Description of the Related Art

The image forming apparatus provided with an inkjet print head to form an image are known as a liquid discharging device.

When discharging ink droplets from nozzles provided in the print head to form an image, an object may clog in the nozzle or the ink may dry to disable discharge of the ink, that is, to cause "false discharge".

The method is known to avoid deterioration in image quality under the existence of a false-discharging nozzle. This method detects whether ink droplets are normally discharged from a nozzle and performs, according to the detection, image processing different from normal printing on input image data to compensate image quality.

SUMMARY

Example embodiments of the present invention include a liquid discharging device, which includes: a liquid discharging head provided with a plurality of nozzles; a discharge detector to detect, among the plurality of nozzles of the liquid discharging head, a normal-discharging nozzle and a false-discharging nozzle; a cleaner to recover discharging performance of the false-discharging nozzle; a compensator to compensate deterioration in an image caused by the false-discharging nozzle using the normal-discharging nozzle; and a selector to select whether to use the cleaner or to use the compensator according to a number of consecutive false-discharging nozzles detected by the discharge detector.

Example embodiments of the present invention include a control apparatus for a liquid discharging device, which detects, among the plurality of nozzles of the liquid discharging head, a normal-discharging nozzle and a false-discharging nozzle using a discharge detector, selects whether to recover discharging performance of the false-discharging nozzle by a cleaner or to compensate deterioration in an image caused by the false-discharging nozzle by a compensator using the normal-discharging nozzle according to a number of consecutive false-discharging nozzles detected in the detection, and controls the liquid discharging device to perform operation according to the selection.

Example embodiments of the present invention include a method for controlling the liquid discharging device, and a non-transitory recording medium storing a control program for controlling the liquid discharging device.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein:

FIG. 7 illustrates example tables A, B, and C each storing information on the number of consecutive false-discharged pixels and patterns of the combination of false-discharging nozzles according to an embodiment of the present invention;

FIG. 9 is a flowchart illustrating operation of compensating image data according to an embodiment of the present invention;

Figure 1:
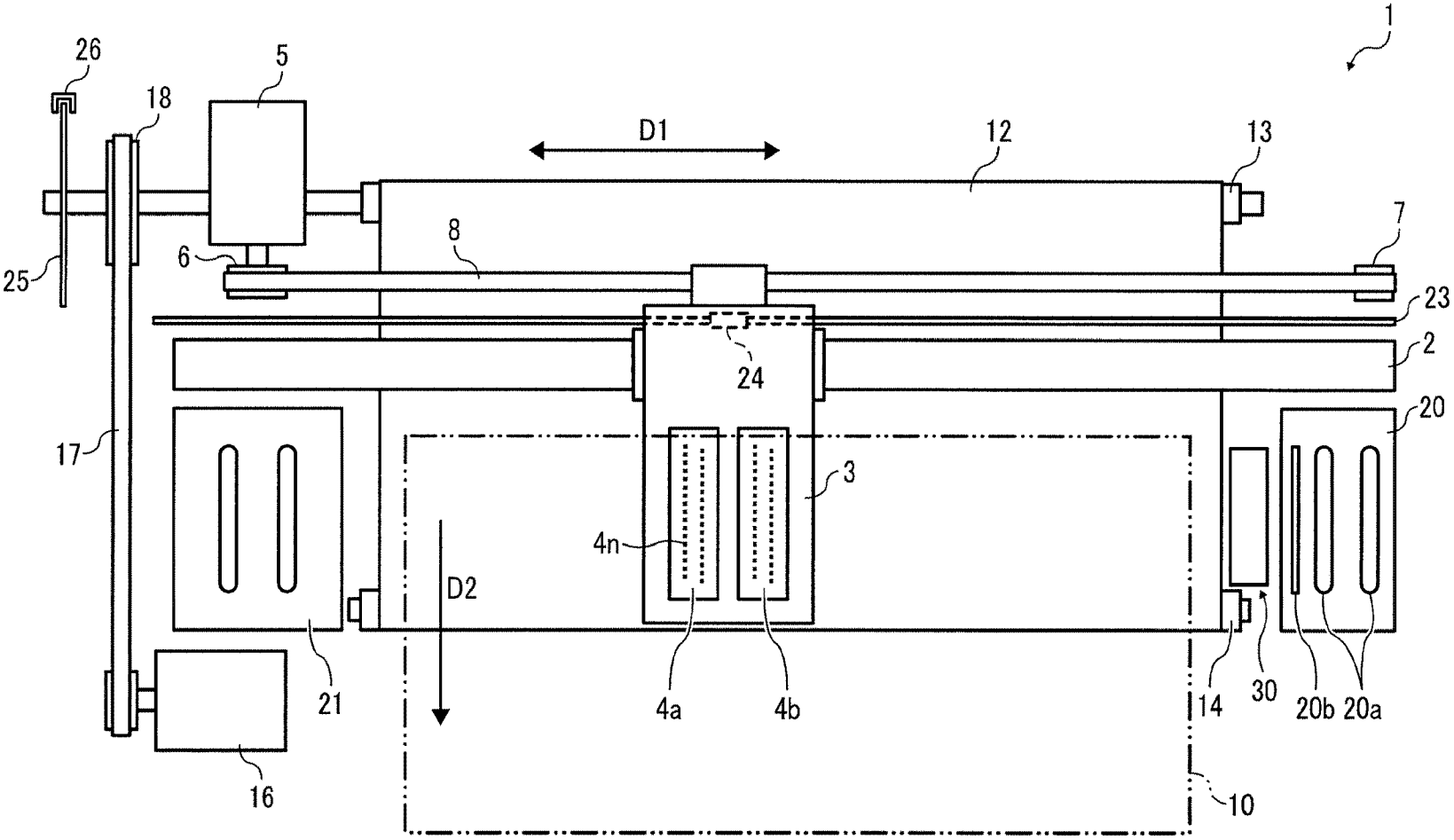
FIG. 1 is a plan view illustrating a serial type inkjet printer, as an example of an image forming apparatus according to a first embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

FIG. 1 is a plan view schematically illustrating a serial type inkjet printer, which is a liquid discharging device according to a first embodiment of the present invention. In the serial type inkjet printer 1, the direction in which a carriage moves is referred to as a main-scanning direction (D1 in FIG. 1) and the direction in which a recording medium is conveyed is referred to as a sub-scanning direction (D2 in FIG. 1).

The serial type inkjet printer 1 includes a main guide 2 laterally bridging between the right and left side plates, and a movable carriage 3 serving as a slave guide movable along the main guide 2. A main-scanning motor 5 moves the carriage 3 via a timing belt 8 looped around a driving pulley 6 and a driven pulley 7 to reciprocate in the main-scanning direction.

Print heads 4 (4*a*, 4*b*), serving as liquid discharging heads, are mounted on the carriage 3. The print head 4 discharges ink droplets of colored ink, for example, yellow (Y), cyan (C), magenta (M), and black (K). A nozzle array 4*n* including a plurality of nozzles aligned along the sub-scanning direction perpendicular to the main-scanning direction is mounted on the print head 4 with the nozzles directed to eject ink droplets downward.

The print heads 4*a* and 4*b* each includes two nozzle arrays each including a plurality of nozzles. For example, one of the nozzle arrays of the print head 4*a* ejects droplets of K and the other nozzle array ejects droplets of C. One of the nozzle arrays of the print head 4*b* ejects droplets of M and the other nozzle array ejects droplets of Y. The liquid discharging head provided as the print heads 4*a* and 4*b* may be, for example, a piezoelectric actuator such as a piezoelectric element or a thermal actuator using electric/heat conversion element such as a heat element to function by a phase change occurring under liquid film boiling.

The serial type inkjet printer 1 includes a seamless conveying belt 12 serving as a conveyer that electrostatically attracts a sheet 10 and carries the sheet 10 in front of the print head 4 (4*a* and 4*b*).

The conveying belt 12 is looped around a conveyance roller 13 and a tension roller 14. A sub-scanning motor 16 drives, via a timing belt 17 and a timing pulley 18, the conveyance roller 13 to rotate. The conveyance roller 13 drives the conveying belt 12 to rotate in the sub-scanning direction.

The conveying belt 12 is electrically charged by a charging roller during rotation. A maintainer 20 serving as a cleaner that keeps or recovers the function of the print head 4 is provided aside the conveying belt 12 along one side of the main-scanning direction of the carriage 3. A dummy-discharge receiver 21 that receives ink discharged by the print head 4 for checking is provided at the other side of the conveying belt 12 along the main-scanning direction.

Not only the conveying belt 12 that electrostatically attracts the sheet 10 but the conveyance roller 13 that conveys the sheet 10 and a platen that catches the sheet 10 may together serve as a conveyer that conveys the sheet 10. In this case, another conveyance roller 13 is provided in the sheet-ejection region in place of the tension roller 14 so that the sheet 10 is conveyed, making contact with both the conveyance rollers 13 in the sheet-feeding region and the sheet-ejection region. Other than the conveying belt 12 that electrostatically attracts the sheet 10, the sheet 10 may be conveyed using a suctioner that catches the sheet 10 by suctioning air through a hole created in a platen.

The maintainer 20 includes, for example, a cap 20*a* for capping the nozzle face of the print head 4, a wiper 20*b* for wiping the nozzle face, and a dummy-discharge receiver that receives discharged droplets not contributing to the forming of an image. A discharge detector 30 is provided between the conveying belt 12 and the maintainer 20, outside the print region, so as to oppose the print head 4.

An encoder scale 23 forming a predetermined pattern is provided between the side plates along the main-scanning direction of the carriage 3. A main-scanning encoder sensor 24 including a transmission photosensor is provided on the carriage 3 to read the pattern of the encoder scale 23. The encoder scale 23 and the main-scanning encoder sensor 24 constitute a linear encoder (main-scanning encoder) that detects the movement of the carriage 3.

A code wheel 25 is mounted on the shaft of the conveyance roller 13. A sub-scanning encoder sensor 26 including a transmission photosensor facing both sides of the rim of the code wheel 25 to detect the pattern on the code wheel 25 is provided. The code wheel 25 and the sub-scanning encoder sensor 26 constitute a rotary encoder (sub-scanning encoder) that detects the moved distance and position of the conveying belt 12.

In the serial type inkjet printer 1 described above, the charged conveying belt 12 attracts the sheet 10 fed from the sheet-feeding tray and rotates to convey the sheet 10 in the sub-scanning direction. After the sheet 10 comes to a predetermined position and stops, the print head 4 is driven by an image signal while the carriage 3 moves in the main-scanning direction. Printing is performed by discharging ink droplets onto the sheet 10 for each row. On receiving a print-finish signal or a signal indicating that the trailing edge of the sheet 10 has reached the print region, the serial type inkjet printer 1 finishes printing and ejects the sheet 10 to the sheet-ejection tray.

Figure 2B:
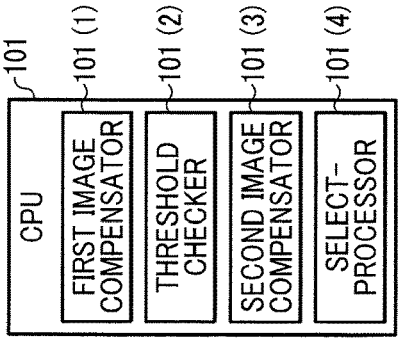
FIG. 2B is a functional block diagram of a main controller of the image forming apparatus illustrated in FIG. 2A according to an embodiment of the present invention.
Figure 2A:
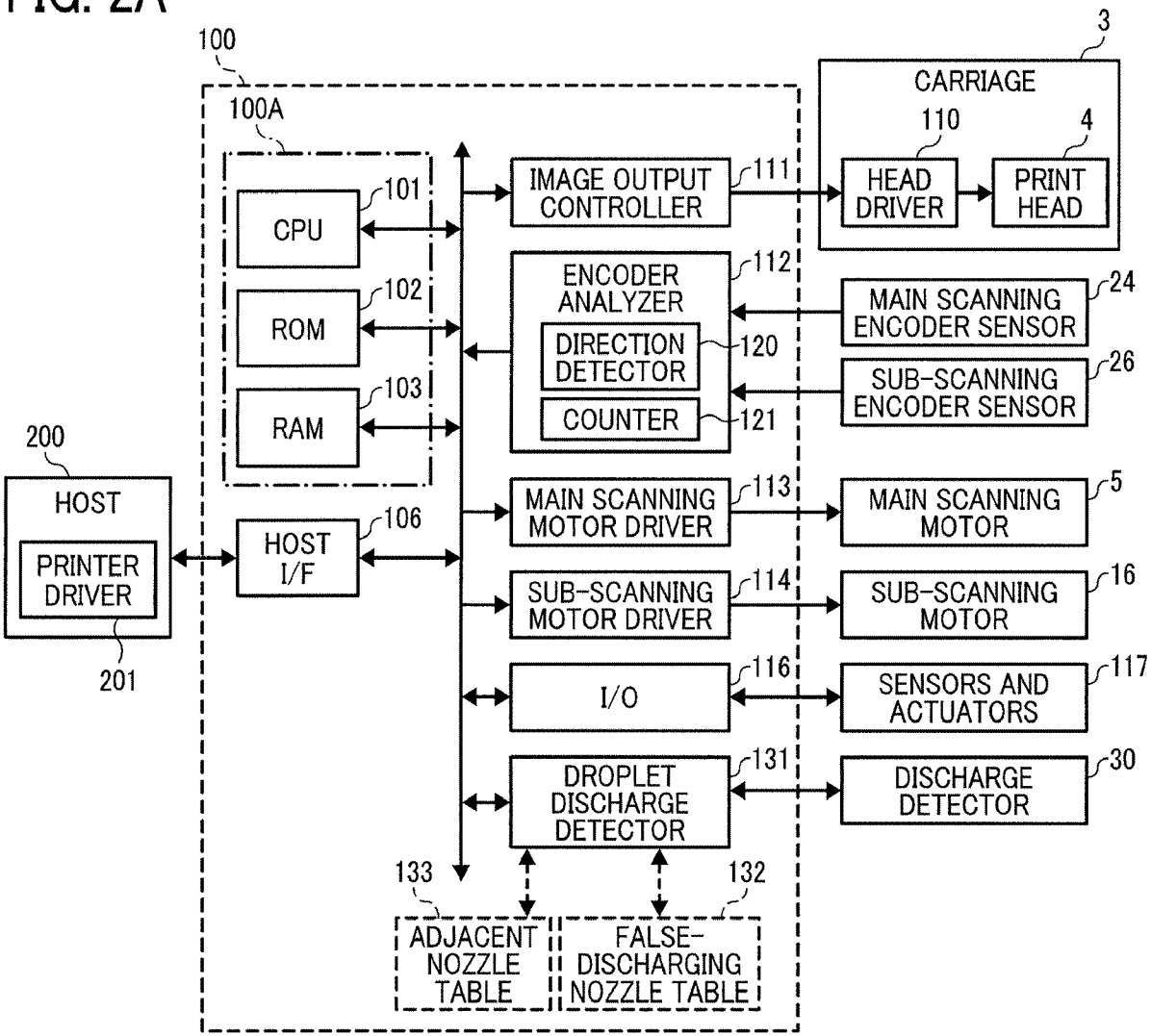
FIG. 2A is a block diagram illustrating a controller of the image forming apparatus illustrated in FIG. 1 according to an embodiment of the present invention.

How the serial type inkjet printer 1 is controlled will now be described. FIGS. 2A and 2B illustrate a controller of the image forming apparatus.

FIG. 2A is a block diagram schematically illustrating a controller 100 of the serial type inkjet printer 1, and FIG. 2B is a functional block diagram of the main controller 100A. The controller 100 includes a main controller (computer) 100A, which includes, for example, a CPU 101 that controls the whole apparatus, a read-only memory (ROM) 102 storing a program executed by the CPU 101 and other fixed data, and a random access memory (RAM) 103 that temporarily stores image data or the like.

The controller 100 further includes a host interface (I/F) 106 that transmits data between a host (information processing apparatus) 200, such as a personal computer (PC), an image output controller 111 that drives and controls the print head 4, and an encoder analyzer 112.

The encoder analyzer 112 analyzes detection signals input from the main-scanning encoder sensor 24 and the sub-scanning encoder sensor 26. The controller 100 also includes a main-scanning motor driver 113 that drives and controls the main-scanning motor 5, a sub-scanning motor driver 114 that drives and controls the sub-scanning motor 16, and an input/output (I/O) 116 that connects to the sensors and actuators 117. The controller 100 includes a droplet discharge detector 131 that detects whether a nozzle is a normal-discharging nozzle or a false-discharging nozzle by the discharge detector 30.

The image output controller 111 outputs a drive waveform, a head-controlling signal, print data, for example, to a head driver 110 serving as a head driving circuit for driving the print head 4 mounted on the carriage 3 to discharge droplets from the nozzle of the print head 4 according to the print data.

The image output controller 111 includes a data composer that composes print data, a drive waveform generator that generates a drive waveform for driving and controlling the print head 4, and a data transmitter that transmits a head-controlling signal and print data used for selecting a predetermined drive signal in a drive waveform.

The encoder analyzer 112 includes a direction detector 120 that detects the moved direction of the carriage 3 from a detection signal, and a counter 121 that detects the moved distance of the carriage 3.

The controller 100 controls and drives the main-scanning motor 5 via the main-scanning motor driver 113 based on the analysis in the encoder analyzer 112 to control the movement of the carriage 3. The controller 100 also controls and drives the sub-scanning motor 16 via the sub-scanning motor driver 114 to control the feeding of the sheet 10.

The main controller 100A of the controller 100 is a computer, which includes a compensator that compensates deterioration in an image and a selector that selects whether to use a maintainer 20 or the compensator. As illustrated in FIG. 2B, the main controller 100A (CPU 101) includes a first image compensator 101(1), a threshold checker 101(2), a second image compensator 101(3), and a select-processor 101(4), each of which corresponds to a function to be performed by the CPU 101 according to a control program.

The first image compensator 101(1) performs n-value (n 2) error diffusion processing on multiple data of an input image data for liquid discharge and adds a quantization error to the pixels near the pixel corresponding to the false-discharging nozzle.

The threshold checker 101(2) compares the pixel value corresponding to the false-discharging nozzle with a predetermined threshold.

If the pixel value corresponding to the false-discharging nozzle checked by the threshold checker 101(2) is equal to or higher than the threshold, the second image compensator 101(3) replaces a small dot among the dots printed by the normal-discharging nozzle near the false-discharging nozzle with a larger dot by pattern matching using a predetermined pattern corresponding to the shape and arrangement of the dots near the false-discharging nozzle.

The select-processor 101(4) selects according to the number of consecutive false-discharging nozzles detected by the discharge detector 30 whether to clean the print head 4 using the maintainer 20 or to compensate the image without cleaning. This prevents creation of false-discharged pixels which deteriorates the compensation effect.

The main controller 100A controls the print head 4 to move and discharge droplets from a predetermined nozzle of the print head 4, and determines the state of droplet-discharge according to a detection signal transmitted from the droplet discharge detector 131 in detecting the droplet discharge of the print head 4. This operation of detecting the droplet discharge is performed by the CPU 101 of the main controller 100A according to the program that is read from the ROM 102 to the RAM 103.

Detection of a false-discharging nozzle will now be described. FIGS. 3A to 4B illustrate how a false-discharging nozzle is detected.

Figure 3A:
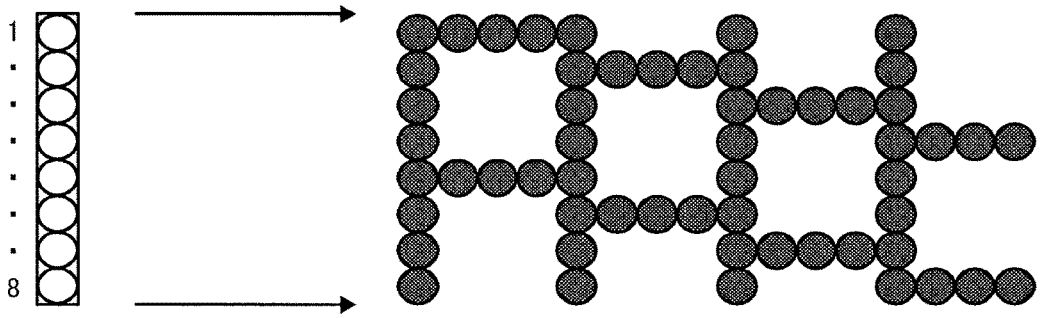
FIGS. 3A and 3B are figures for explaining a method of detecting a false-discharging nozzle according to an embodiment of the present invention.

FIG. 3A illustrates an example check pattern for checking a lateral line reproduced by each nozzle to visually detect the false-discharging nozzle. If the dots corresponding to the third nozzle is a false-discharging nozzle, the dots corresponding to the false-discharging third nozzle will not appear in the pattern as illustrated in FIG. 3B, as compared to the pattern for detecting the false-discharging nozzle illustrated in FIG. 3A.

Figure 3B:
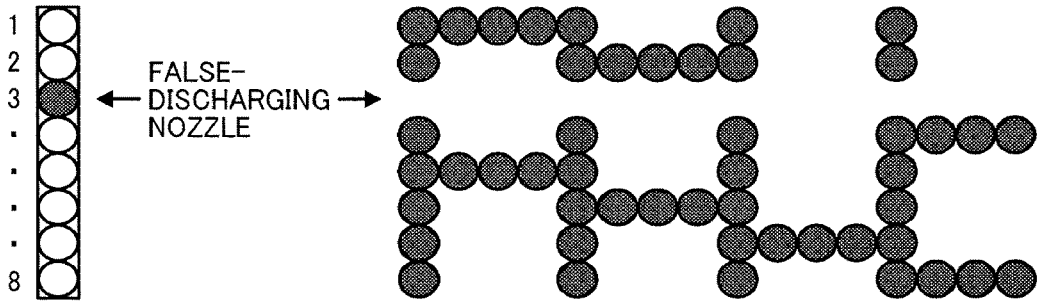

Using the pattern for detecting the false-discharging nozzle as illustrated in FIG. 3A in comparison with the pattern illustrated in FIG. 3B, a user inputs the location of the false-discharging nozzle (information on unprinted dots) through an input device, such as a keyboard and a mouse, equipped in the host 200.

Figure 4A:
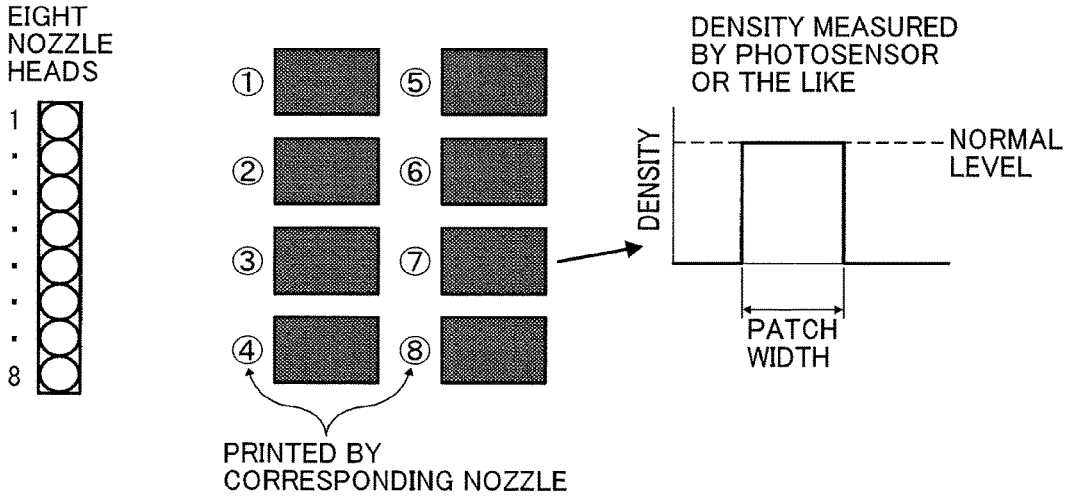
FIGS. 4A and 4B are figures for explaining a method of detecting a false-discharging nozzle according to an embodiment of the present invention.
Figure 4B:
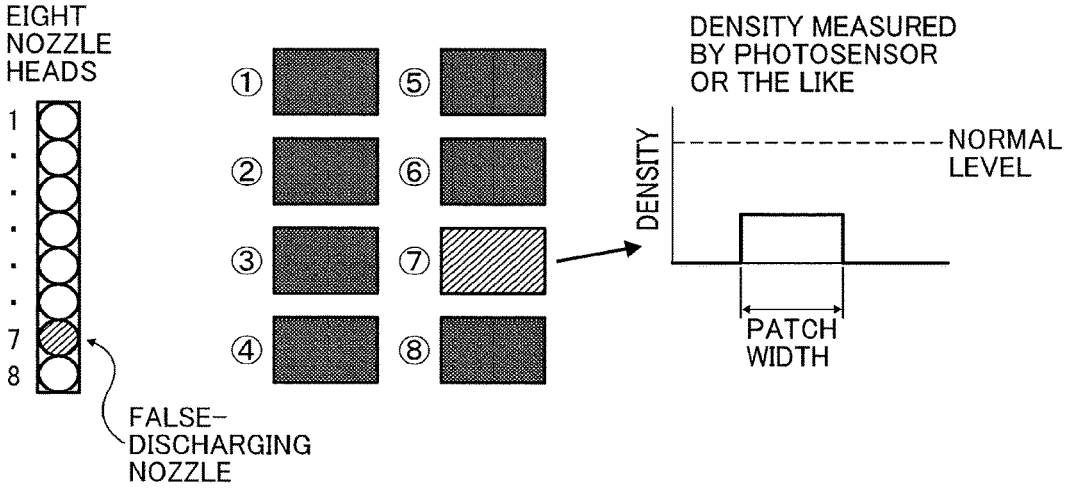

In alternative to visual detection, the pattern for detecting the false-discharging nozzle illustrated in FIG. 3A, which is an example checking pattern, may be used to automatically detect the false-discharging nozzle by the droplet discharge detector 131 illustrated in FIG. 2A using, for example, a scanning unit or a photosensor (corresponding to the discharge detector 30 illustrated in FIG. 2A). As illustrated in FIGS. 4A and 4B, each print region of the pattern for detecting the false-discharging nozzle is printed only by the designated nozzle of the print head 4. For example, FIG. 4B illustrates an example case in which the seventh nozzle is a false-discharging nozzle. In such case, the density measured by a photosensor or the like of the pattern corresponding to the false-discharging seventh nozzle becomes below a normal level as illustrated in FIG. 4B. Using the pattern for detecting the false-discharging nozzle, for example, the seventh nozzle is determined as a false-discharging nozzle.

The method of detecting the false-discharging nozzle may be performed in various ways other than the above-described method. For example, the false-discharging nozzle may be detected by driving a print head and irradiating the ink discharged from the print head with a laser beam to detect the discharge-state of ink from the nozzle by detecting the reflected laser beam. Alternatively, the false-discharging nozzle may be detected by discharging charged droplets onto an electrode plate and detecting the movement of the charge on the electrode plate.

The processing performed by the main controller 100A of the serial type inkjet printer 1 will now be described. In this processing, the droplet discharge detector 131 determines the state of droplet-discharge, namely, detects whether the nozzle is a normal-discharging nozzle or a false-discharging nozzle. The detection can be performed not only by the method described above but also by other methods, such as detecting ink droplets by a droplet discharge detector provided in the serial type inkjet printer 1.

For example, the droplet discharge detector 131 determines whether the nozzle is a normal-discharging nozzle or a false-discharging nozzle according to an image data input to the droplet discharge detector 131. By this method, processing suitable for an image to be formed can be performed.

The select-processor 101(4) of the serial type inkjet printer 1 then selects whether to perform cleaning or compensation according to detection of the false-discharging nozzle. If the number of consecutive false-discharging nozzles reaches a predetermined number, cleaning is performed by the maintainer 20 and if the number of consecutive false-discharging nozzles is below the predetermined number, compensation of the image is performed.

A method of counting the number of consecutive false-discharging nozzles will now be described.

Figure 5:
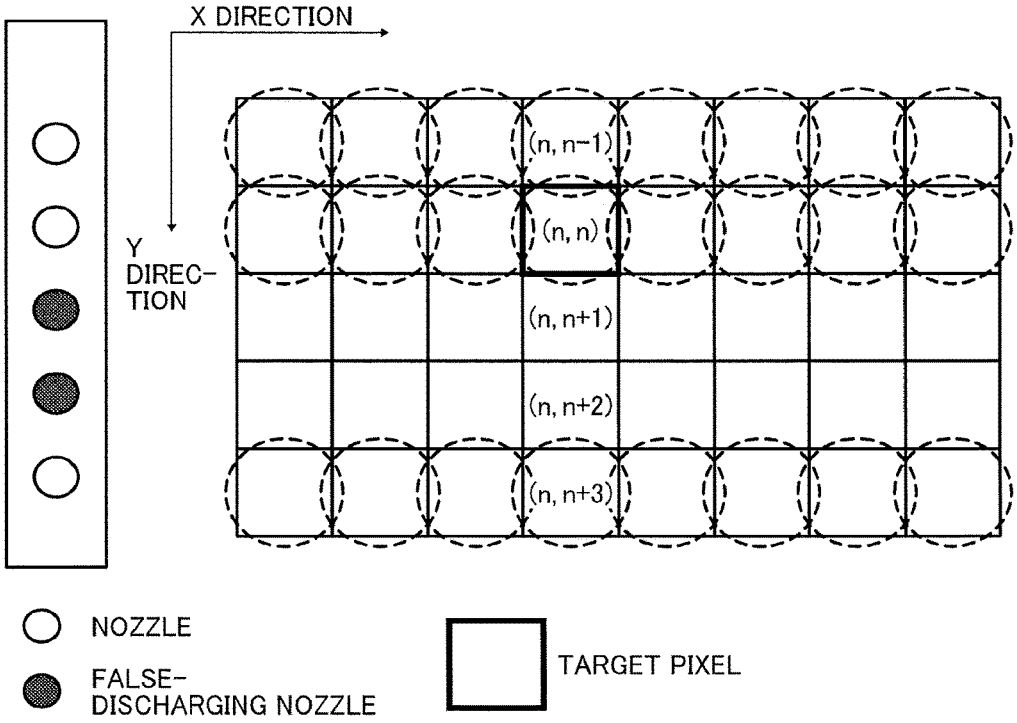
FIG. 5 is a figure for explaining a method of counting the number of consecutive false-discharged pixels on dot-arrangement data according to an embodiment of the present invention.

FIG. 5 is a figure for explaining a method of counting the number of consecutive false-discharged pixels in dot-arrangement data.

The input data is counted on the arrangement of ink-dots illustrated in FIG. 5. In FIG. 5, the scanning direction of the print head is represented by X, the conveyance direction of a sheet is represented by Y, and the location of a target pixel is represented by (X, Y)=(n, n). The method of counting is such that pixels are counted along the Y direction starting from the pixel adjacent the target pixel, counting up the number of consecutive false-discharged pixels $\alpha$ if the pixel is a false-discharged pixel.

If the adjacent pixel is not a false-discharged pixel, counting along this direction finishes. In the example illustrated in FIG. 5, pixel (n, n−1) adjacent to the target pixel in the upstream Y direction is not a false-discharged pixel, so the counting finishes. Pixel (n, n+1) and pixel (n, n+2) adjacent the target pixel in the downstream Y direction are false-discharged pixels, so that $\alpha$ is counted up two times. The next pixel (n, n+3) is not a false-discharged pixel, so that counting finishes.

Thus, the number of consecutive false-discharged pixels is 0 in the upstream of the target pixel (n, n) and 2 in the downstream, and thus the number of consecutive false-discharged pixels $\alpha$ is 2.

The method of counting the number of consecutive false-discharged pixels described above is an example. The direction of counting and the method of counting up consecutive false-discharged pixels are not necessarily the above method. The number of consecutive false-discharged pixels may be counted up also in the X direction. The number of consecutive false-discharged pixels may be handled by the sum of the counted numbers toward the upstream and downstream in the Y direction as in the example method, or alternatively, may independently be handled by each number counted in the upstream and the downstream.

Figure 6A:
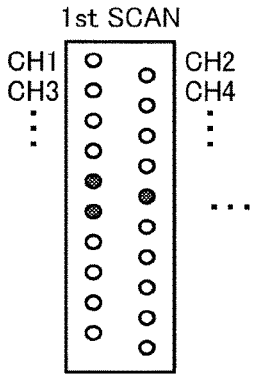
FIGS. 6A, 6B, and 6C are figures for explaining a method of counting the number of consecutive false-discharged pixels from a combination of false-discharging nozzles according to an embodiment of the present invention.
Figure 6B:
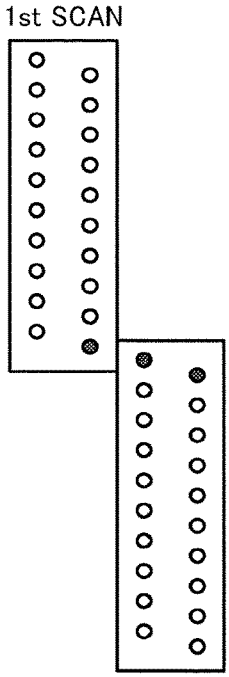
Figure 6C:
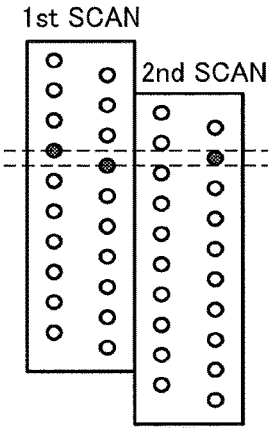

The method of counting the consecutive false-discharged pixels is not necessarily the method based on the dot-arrangement data as illustrated in FIG. 5. FIGS. 6A, 6B, and 6C are figures for explaining a method of counting the number of consecutive false-discharged pixels from a combination of false-discharging nozzles.

FIGS. 6A, 6B, and 6C illustrate example patterns detected by the droplet discharge detector 131. Each pattern is the combination of false-discharging nozzles with three false-discharged pixels consecutively located along the sub-scanning direction (vertical direction in FIGS. 6A, 6B, and 6C).

FIGS. 6A, 6B, and 6C illustrate combinations of false-discharging nozzles that create consecutive false-discharged pixels. FIG. 6A illustrates a pattern of nozzles of a print head in a staggered arrangement where three consecutive nozzles are false-discharging nozzles. FIG. 6B illustrates a pattern where two print heads are connected along the sub-scanning direction and a false-discharging nozzle of one of print heads is located consecutive to a false-discharging nozzle of the other print head. FIG. 6C illustrates a pattern for multiple scanning printing where a pixel printed by a false-discharging nozzle during the first scan is located consecutive to a pixel printed by another false-discharging nozzle during the second scan.

FIG. 7 illustrates example tables each storing information on the number of consecutive false-discharged pixels detected by the droplet discharge detector 131 and patterns of the combination of false-discharging nozzles.

As illustrated in FIG. 7, the number and patterns of consecutive false-discharged pixels illustrated in FIGS. 6A, 6B, and 6C can be handled by the tables storing patterns of the combination of the number of consecutive false-discharged pixels and the nozzle numbers (channels: CHs) of the false-discharging nozzles.

Tables A to C in FIG. 7 respectively correspond to FIGS. 6A, 6B, and 6C. Handled by the tables A to C, the number of consecutive false-discharged pixels needs not be counted according to the dot-arrangement data as in FIG. 5 every time when such information is necessary but can be obtained by just determining each nozzle as a normal-discharging nozzle or a false-discharging nozzle.

In the embodiment, the table illustrated in FIG. 7 is referred to as a false-discharging nozzle table 132 (FIG. 2A).

Figure 8:
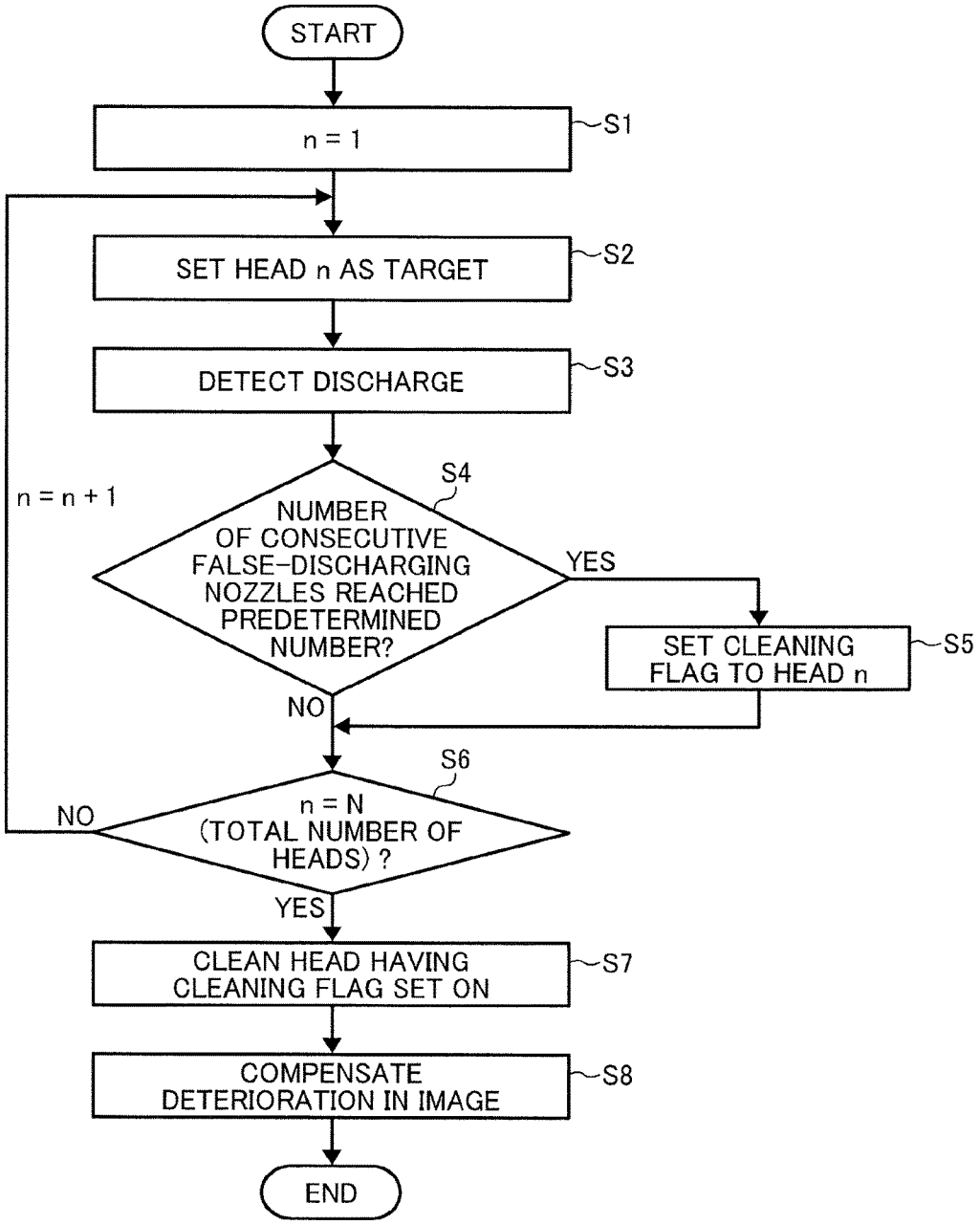
FIG. 8 is a flowchart illustrating operation of selecting whether to clean a print head or to compensate an image according to an embodiment of the present invention.

FIG. 8 is a flowchart illustrating operation of selecting whether to clean the print head or to compensate the image, performed by the CPU 101. The select-processor 101(4) sets an initial n value as 1 (step S1). The select-processor 101(4) then performs the following processing for the head n (step S2).

The select-processor 101(4) detects discharge from the head n (n is the head number: n=1 to N) (step S3) and determines whether pixels are consecutively missing by a predetermined number (step S4).

Whether to clean the print head is determined based on the predetermined number of consecutive false-discharged pixels, and the predetermined number can be changed by a user. The predetermined number stored for each mode may differ, so that compensation can be made efficiently.

The select-processor 101(4) sets a flag telling the head n needs cleaning (Step S5) when the number of consecutive false-discharging nozzles exceeds the predetermined number (Yes in Step S4). If the number of consecutive false-discharging nozzles is below the predetermined number (No in Step S4), nothing is performed and the step proceeds to the next processing.

The select-processor 101(4) determines whether discharge from every head has been detected (step S6). The processing finishes when n=N, where N is the total number of the heads. If n<N, n is incremented by 1, that is, n=n+1, and the step proceeds to step S2.

On finishing every detection of discharge from every head, the select-processor 101(4) commands the maintainer 20 to clean the head that has a flag requiring cleaning (step S7).

After finishing the processing, the select-processor 101(4) performs image compensation processing (step S8 in FIG. 9).

Image compensation processing will now be described. FIG. 9 is a flowchart illustrating operation of compensating image data, performed by the CPU 101.

FIG. 9 illustrates the procedure of compensation processing of image data which is executed by the main controller 100A (CPU 101) according to a program when a false-discharging nozzle is detected in the determination processing illustrated in FIG. 8. The program is stored in a recording medium (hereinafter referred to as a program recording medium to distinguish from recording media including a sheet) readable by the general-purpose computer.

The image data for a single scan of the carriage 3 is input to the serial type inkjet printer 1 to start the compensation processing.

The first image compensator 101(1) sets a target pixel to perform image compensation processing (step S101).

The first image compensator 101(1) then determines (or checks) whether the target pixel is to be printed by a false-discharging nozzle (step S102).

If the target pixel is to be printed by a false-discharging nozzle (Yes in step S102), a dot is not created for this pixel (step S103), and the threshold checker 101(2) determines whether the pixel value (gradation value) of this pixel in the image data is equal to or higher than a predetermined threshold (step S104).

If the pixel value of this pixel in the image data is equal to or higher than the threshold (Yes in step S104), the threshold checker 101(2) stores the coordinate of the target pixel in a memory (step S105), and the step proceeds to step S107.

In step S102, if the target pixel is not to be printed by a false-discharging nozzle (No in step S102), the first image compensator 101(1) generates a dot by multiple-error diffusion processing (S106), and the step proceeds to step S107.

The first image compensator 101(1) updates the quantization error (an error resulting from quantization of a pixel) (S107) and then determines whether n-value processing for every pixel (processing of converting multivalued image data into n-value image data) is finished (step S108).

If there is a pixel not yet processed by n-value processing (No in step S108), the first image compensator 101(1) reselects (changes) the target pixel (step S109) and repeats the processing from step S101.

When the n-value processing is finished for every pixel (Yes in step S108), the second image compensator 101(3) determines whether any stored pixel (coordinate) exists (step S110).

If there is a stored pixel (Yes in step S110), the second image compensator 101(3) performs pattern matching for a pixel near the stored pixel (step S111), and the step proceeds to step S112. If no stored pixel exists in step S110 (No in step S110), the step proceeds to step S112.

If processing has not been performed on every target pixel, that is, if an unprocessed pixel exists (No in step S112), the second image compensator 101(3) returns to step S110 and performs the subsequent processing. If the processing has been performed on every target pixel (Yes in step S112), the second image compensator 101(3) outputs the print image data of the single scan and finishes the processing.

Figure 10A:
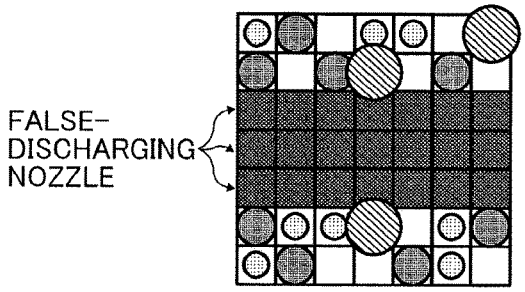
FIGS. 10A and 10B illustrate compensation of false-discharged pixels according to an embodiment of the present invention.
Figure 10B:
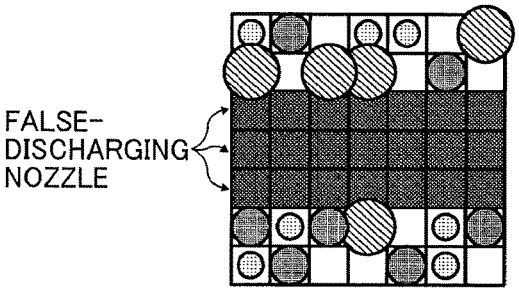

FIGS. 10A and 10B (FIG. 10) illustrate compensation effect for a case where a false-discharged pixel exists.

If consecutive nozzles become false-discharging nozzles (three consecutive false-discharging nozzles in FIG. 10), compensation cannot be made for the pixel row with no adjacent normal pixel. In the adjacent dot scaling and in the error diffusion processing, an image is compensated by enlarging the droplet that forms the pixel adjacent the false-discharged row (See FIG. 10B). In such a processing, if consecutive rows of false-discharged pixels include a pixel row having no adjacent dot as illustrated in FIG. 10, a white line appears in the image even after compensation. To avoid such a trouble, the embodiment detects a false-discharging nozzle by a discharge detection mechanism and cleans the print head 4.

The serial type inkjet printer, which is one example of liquid discharging device, may be implemented in various other ways.

For example, the serial type inkjet printer 1 according to another embodiment includes the controller 100, which additionally includes a false-discharging nozzle table 132 and an adjacent nozzle table 133. The select-processor 101(4) determines the pattern of consecutive false-discharging nozzles according to the information stored in the false-discharging nozzle table 132 and the adjacent nozzle table 133 to select whether to clean the print head 4 or to compensate the image. This enables processing corresponding to the operating mode.

As illustrated in FIG. 7, the false-discharging nozzle table 132 stores in a form of a table the information for identifying which nozzle of which liquid discharging head is a false-discharging nozzle. The information is obtained by a discharge detector 30 and a droplet discharge detector 131. For example, the stored information tells which nozzle of a print head 4 is a normal-discharging nozzle or a false-discharging nozzle.

The adjacent nozzle table 133 identifies adjacent nozzles for a designated mode under which the liquid is discharged from the liquid discharging heads.

The serial type inkjet printer 1 forms an image under various print modes. The order of printing dots during image printing is specified for each mode. Patterns of the order are, for example, 1-pass and 1/1-interlace, 1-pass and 1/2-interlace, 2-pass and 1/2-interlace, 4-pass and 1/2-interlace, 4-pass and 1/4-interlace.

1-pass means that unit elements of an image in the main-scanning direction are all printed by a single scan, and 4-pass means that unit elements of an image in the main-scanning direction are printed by four scans. The print mode is selected according to the print quality and print speed.

In 1-pass and 1/1 interlace, for example, unit elements of an image in the sub-scanning direction are all printed by a single scan. In 1-pass and 1/4 interlace, unit elements of an image in the sub-scanning direction are all printed by four scans.

Figure 11A:
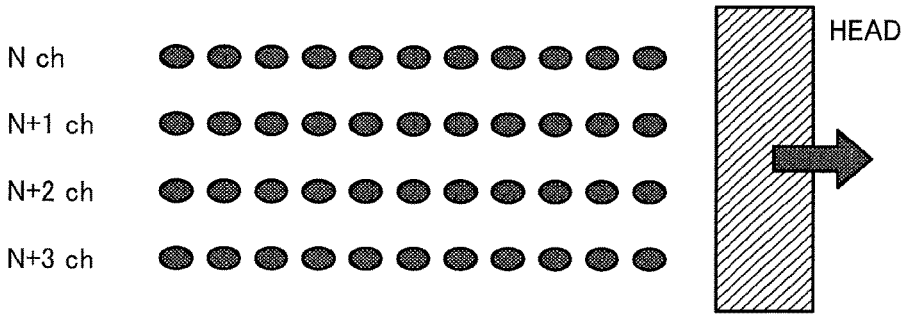
FIGS. 11A and 11B illustrate discharge of ink performed by the print head according to an embodiment of the present invention.
Figure 11B:
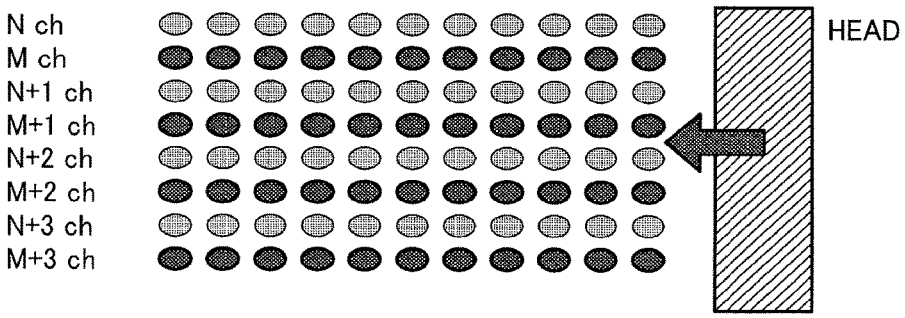

FIGS. 11A and 11B illustrate discharge of ink performed by the print head.

FIG. 11A illustrates printing by 1-pass and 1/2-interlace. Printing during the first scan using the nozzles of N to (N+3) channels will be described.

In the second scan as illustrated in FIG. 11B, the nozzles of M to (M+3) channels print dots on pixels adjacent the pixels on which dots are printed during the first scan. This channel numbers are not always the same. The nozzles for printing dots on an adjacent pixel depend on the feed-amount of a sheet.

Which nozzle prints which adjacent dot depends on the print mode.

The select-processor 101(4) identifies which nozzle is a false-discharging nozzle according to the false-discharging nozzle table 132, and determines which nozzle is adjacent the identified false-discharging nozzle according to the adjacent nozzle table 133.

Figure 12:
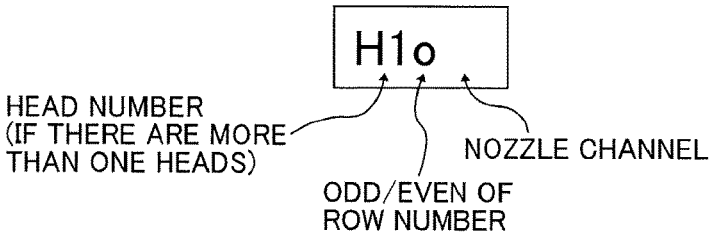
FIG. 12 illustrates an adjacent nozzle table according to an embodiment of the present invention.

FIG. 12 illustrates an adjacent nozzle table 133.

As illustrated in FIG. 12, the adjacent nozzle table 133 stores a table storing information regarding adjacent nozzles. The table is provided for each mode (high speed printing for regular sheet, normal speed printing for regular sheet, etc.).

The adjacent nozzle table 133 stores a table, which includes the nozzle number, information indicating whether the row number is odd or even, and the nozzle channel. When the number of nozzles to be used differs at the leading edge or the trailing edge, the adjacent nozzle table is also prepared for the leading edge and the trailing edge. For example, when a sheet is fed by a very small amount at the leading edge and by a constant amount at the middle portion of the sheet, the adjacent nozzle table is prepared for each feeding amount.

According to the embodiment, the select-processor 101(4) can obtain the number of consecutive false-discharging nozzles during printing for each print mode according to the false-discharging nozzle table 132 and the adjacent nozzle table 133. In this manner, the processing can be performed, taking into the account the effect of false-discharging nozzles by selecting whether to clean the print head 4 or to compensate an image.

The present invention can be applied to a liquid discharging device other than the image forming apparatus of the inkjet type described above as the embodiment of the present invention. The liquid discharging device includes a liquid discharging head or a liquid discharging unit which is driven to discharge liquid. The liquid discharging devices include not only a device that discharges liquid onto a thing to which liquid can adhere but also a device that discharges liquid into gas or liquid, such as a stereo molding device, a process liquid applier, and an ejection granulator.

The liquid discharging devices may include a unit for feeding, conveying, and ejecting things to which liquid can adhere, preprocessing device, and a post-processing device.

Other than the serial type inkjet printer described above, the liquid discharging device may be, for example, a stereo molding device (3-dimensional molding device) that discharges molding liquid into a particulate layer to mold a stereo model (3-dimensional model).

The liquid discharging device is not necessarily the devices that visualize with discharged liquid an image that has a meaning, such as a letter and a figure. For example, the liquid discharging devices include a device forming a pattern that has no meaning and a device forming a stereo model.

The "thing to which liquid adheres" allows liquid to at least temporarily adhere and includes a thing that allows adhering liquid to fix or permeate. Unless specified, anything that allows liquid to adhere is included, in particular, recording media, such as a sheet, a recording sheet, a printing sheet, a film, and a cloth, electronic parts, such as an electronic substrate and a piezoelectric element, and media, such as a particulate layer (powder layer) an organ model and a testing cell.

The "thing to which liquid adheres" may be made of any material that allows liquid to temporarily adhere, such as paper, a string, fiber, fabric, leather, metal, plastic, glass, wood, and ceramic.

The "liquid" may be any liquid that has a viscosity and a surface tension allowing the liquid to be discharged from a head. The viscosity is preferably 30 mPa·s or below under a normal temperature and a normal pressure or under heating or cooling. More specifically, the liquid may be a solution, a suspension, or an emulsion including, for example, solvent such as water and organic solvent, a colorant such as dye and pigment, a functional material such as polymerized compound, resin, and surfactant, a biocompatible material such as DNA, amino acid and protein, and calcium, and edible material such as natural colorant. These may be used as, for example, inkjet ink, surface treatment liquid, a liquid for forming an element of an electronic device or a light emitting device and a resist pattern of an electronic circuit, and a material liquid for 3-dimensional molding.

The "liquid discharging device" is not necessarily a device that moves a liquid discharging head relative to a thing that allows liquid to adhere. Specifically, the liquid discharging device includes a serial type device that moves the liquid discharging head and a line type device that does not move the liquid discharging head.

The "liquid discharging device" further includes a process liquid applier that applies process liquid to the surface to reform the sheet surface, and an ejection granulator that ejects constituent liquid including a raw material dissolved in a solution from a nozzle to granulate fine particles of the raw material.

As described above, the serial type inkjet printer 1 according to an embodiment selects whether to use the maintainer 20 or to use the first image compensator 101(1) and the second image compensator 101(3) according to the number of consecutive false-discharging nozzles detected by the droplet discharge detector 131. This avoids creation of consecutive false-discharged pixels that deteriorates the compensation effect. The print head 4 is cleaned at an appropriate timing, but even without cleaning, an image is compensated to keep sufficient quality.

In an embodiment, the droplet discharge detector 131 determines whether a nozzle is a normal-discharging nozzle or a false-discharging nozzle using input data for liquid discharge. This enables suitable processing of an image to be formed.

In an embodiment, the select-processor 101(4) determines the pattern of consecutive false-discharging nozzles according to the information stored in the false-discharging nozzle table 132 and the adjacent nozzle table 133. This enables processing corresponding to an operating mode.

In an embodiment, the image is formed with compensation of a pixel near the pixel corresponding to a false-discharging nozzle using the normal-discharging nozzle. This prevents deterioration in image quality without unnecessary cleaning.

In an embodiment, the maintainer 20 cleans the print head 4 when the number of consecutive false-discharging nozzles reaches a predetermined number. A suitable number of false-discharging nozzles can thus be set.

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

In one example, the controller for controlling discharge of a liquid may be implemented by a computer that is separate from the liquid discharging device. In such case, the computer, operating as the main controller 100A having the functions described above referring to FIG. 2B, cooperates with the controller 100 of the liquid discharging device.

What is claimed is:

1. A liquid discharging device comprising:

plural liquid discharging heads, each provided with a plurality of nozzles;

a discharge detector to detect, among the plurality of nozzles of the liquid discharging heads, a normal-discharging nozzle and a false-discharging nozzle;

a cleaner to recover discharging performance of the false-discharging nozzle;

a compensator to compensate deterioration in an image caused by the false-discharging nozzle using the normal-discharging nozzle; and a selector to select, for each liquid discharging head, whether to use the cleaner based on whether a prestored combination of false-discharging nozzles of two or more liquid discharging heads has been detected by the discharge detector.

2. The liquid discharging device according to claim 1, wherein the discharge detector determines whether each nozzle of the liquid discharging head is the normal-discharging nozzle or the false-discharging nozzle using input data for liquid discharge.

3. The liquid discharging device according to claim 1, further comprising:

a memory to store false-discharging nozzle information for identifying which nozzle of which liquid discharging head is the false-discharging nozzle, and adjacent nozzle information for identifying an adjacent nozzle for an operating mode under which liquid is discharged from a liquid discharging head, wherein the selector identifies the pre-stored combination of false-discharging nozzles according to the false-discharging nozzle information and the adjacent nozzle information.

4. The liquid discharging device according to claim 1, wherein the compensator compensates deterioration in an image by forming an image on a pixel near a pixel corresponding to the false-discharging nozzle using the normal-discharging nozzle.

5. The liquid discharging device according to claim 1, wherein the selector determines to use the cleaner for a respective liquid discharging head when the discharge detector detects the pre-stored combination of false-discharging nozzles.

6. The liquid discharging device according to claim 1, wherein, after using the cleaner for all liquid discharging heads for which use of the cleaner is selected by the selector, the compensator is used to compensate for remaining deterioration in the image.

7. A control apparatus that controls a liquid discharging device including plural liquid discharging heads, the control apparatus comprising a controller configured to:

obtain, from the liquid discharging device, information on detection of a normal-discharging nozzle and a false-discharging nozzle of each respective liquid discharging head;

select, for each respective liquid discharging head, whether to instruct the liquid discharging device to recover discharging performance of the respective liquid discharging head based on whether a pre-stored combination of false-discharging nozzles of two or more liquid discharging heads is provided by the information on detection; and control the liquid discharging device to perform operation according to the selection.

8. The control apparatus according to claim 7, wherein the controller instructs the liquid discharging device to recover discharging performance of the respective liquid discharging head when the liquid discharging device detects that a number of consecutive false-discharging nozzles has reached a predetermined number.

9. A liquid discharge system comprising:

the control apparatus of claim 7; and the liquid discharging device.

10. A method of controlling a liquid discharging device including plural liquid discharging heads, the method comprising:

detecting, among a plurality of nozzles of each respective liquid discharging head, a normal-discharging nozzle and a false-discharging nozzle using a discharge detector;

selecting, for each respective liquid discharging head, whether to recover discharging performance of the respective liquid discharging head by a cleaner based on whether a pre-stored combination of false-discharging nozzles of two or more liquid discharging heads is detected in the detection; and controlling the liquid discharging device to perform operation according to the selection.

* * * * *